US007644494B2

(12) United States Patent
Dinh

(10) Patent No.: US 7,644,494 B2
(45) Date of Patent: Jan. 12, 2010

(54) WIRE TERMINAL INSTALLATION TOOL

(75) Inventor: Cong Thanh Dinh, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 361 days.

(21) Appl. No.: 11/049,165

(22) Filed: Feb. 2, 2005

(65) Prior Publication Data

US 2005/0191894 A1 Sep. 1, 2005

Related U.S. Application Data

(60) Provisional application No. 60/548,595, filed on Feb. 27, 2004.

(51) Int. Cl.
*H01R 43/00* (2006.01)

(52) U.S. Cl. ..... 29/747; 29/758; 29/748

(58) Field of Classification Search ..... 29/729, 29/739, 758–764, 747–752; 7/107; 140/106; 30/90.1

See application file for complete search history.

(56) References Cited

U.S. PATENT DOCUMENTS

| | | | | | |
|---|---|---|---|---|---|
| 2,976,608 | A * | 3/1961 | Busler | 29/254 |
| 3,074,155 | A | 1/1963 | Cootes et al. | |
| 3,110,093 | A | 11/1963 | Johnson | |
| 3,135,147 | A * | 6/1964 | Lau et al. | 173/203 |
| 3,460,229 | A | 8/1969 | Crew et al. | |
| 3,538,585 | A | 11/1970 | Hendry et al. | |
| 3,605,234 | A | 9/1971 | Bogursky | |
| 3,627,367 | A | 12/1971 | Levy | |
| 3,636,612 | A | 1/1972 | Suprun | |
| 3,811,168 | A | 5/1974 | Anderson et al. | |
| D252,131 | S | 6/1979 | Einhorn et al. | |
| 4,171,565 | A | 10/1979 | Boudreau et al. | |
| 4,351,109 | A | 9/1982 | Kelly et al. | |
| 4,399,608 | A * | 8/1983 | Ingaglio | 29/747 |
| 4,414,736 | A | 11/1983 | Fieberg et al. | |
| 5,161,301 | A * | 11/1992 | Kilsdonk | 29/739 |
| 5,177,846 | A | 1/1993 | Bryant | |
| 5,655,294 | A | 8/1997 | Makino | |
| 6,094,780 | A * | 8/2000 | McGlothlin et al. | 16/430 |
| D431,171 | S | 9/2000 | Fallandy | |
| 6,311,392 | B1 | 11/2001 | Lin | |
| 6,732,426 | B2 * | 5/2004 | Adams | 29/762 |

* cited by examiner

*Primary Examiner*—Minh Trinh
(74) *Attorney, Agent, or Firm*—Hoffmann & Baron, LLP

(57) ABSTRACT

A tool for effecting attachment of an electrical terminal terminated on a wire with respect to a mating electrical contact is provided including an elongate tubular body having a first opened end, a second opened end and a continuous slot from the first to the second opened end. The continuous slot defines a pair of inwardly deflectable opposed sidewalls, wherein the wire may be loosely received between the opposed sidewalls. A first recessed stop toward the first opened end of the tubular body is adapted to seat at least the terminal at the first opened end. The opposed sidewalls are inwardly deflectable so as to grip the wire to effect attachment to the mating electrical contact.

14 Claims, 6 Drawing Sheets

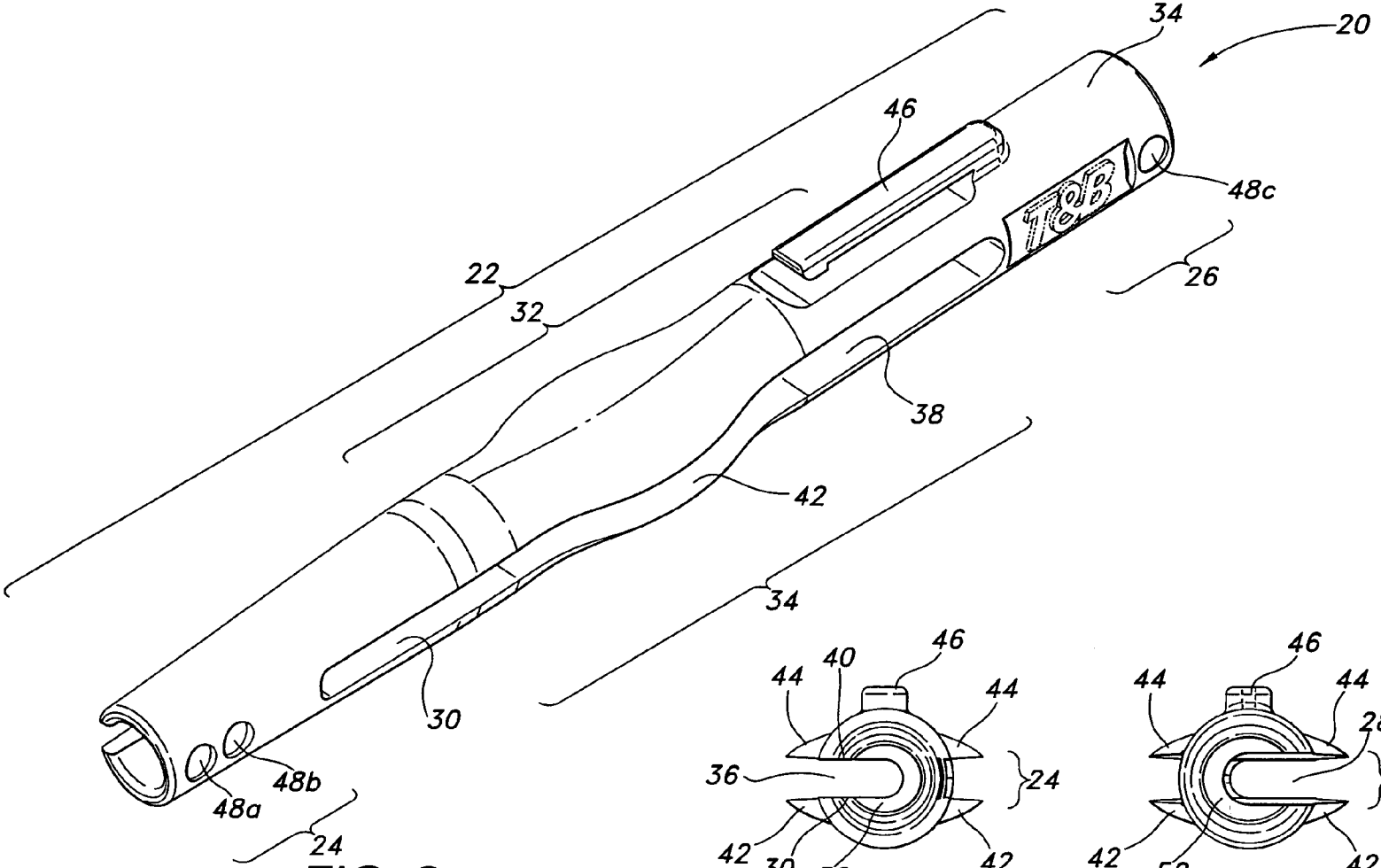
FIG. 2
FIG. 3
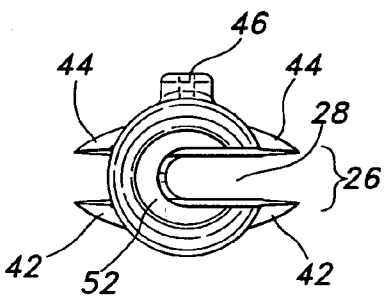
FIG. 4

WIRE TERMINAL INSTALLATION TOOL

CROSS-REFERENCE TO RELATED APPLICATION

This Application claims priority to U.S. Provisional Application No. 60/548,595, filed Feb. 27, 2004, the entire contents of which are incorporated by reference herein.

FIELD OF THE INVENTION

The present invention relates to a tool for placement of an electrical terminal with respect to a mating electrical contact. More particularly, the present invention relates to a tool which provides for controlled orientation and placement of the terminal with respect to the contact while accommodating a variety of sizes of terminals and wires attached thereto.

BACKGROUND OF THE INVENTION

Terminals are widely used in the field of electrical connections. Examples of commonly used electrical terminals include crimp terminals, ring terminals, butt terminals, butt splices, butt disconnects, bullet connectors, blade terminals, pin terminals and the like. These terminal contacts provide reliable connections in a variety of industrial applications.

Typical terminals provide a connection between a wire attached to the terminal and a contact mated to receive the terminal. Terminals may be used with a range of wire gauges, typically from about 6 American Wire Gauge (AWG) to about 22 AWG. Referring now to FIG. 1, a conventional terminal connected to a wire is shown. The terminal, generally referred to as reference numeral 10, includes a conductive contact 14 covered at least in part by an insulating sleeve 16. The contact 14 includes a distal contact portion and a proximal crimp barrel portion. The crimp barrel portion is crimped about a wire 18 which include an electrical conductor (not shown) inside an insulative jacket. Distal contact portion of contact 14 matingly corresponds to the electrical contact with which it is designed to be used. As shown, contact 14 is a vinyl insulated female disconnect adapted to fit securely about a blade shaped contact (not shown). Attachment of terminal 10 to the mating contact establishes an electrical connection therebetween.

The efficacy of the electrical connection made by a terminal with its corresponding or mating contact is related to how completely and securely the terminal is seated on the mating contact. Failure to properly seat the terminal so as to achieve a secure fit with the mating contact may compromise the integrity of the electrical connection.

In many modern configurations, electrical contacts are closely spaced to one another and arranged behind a protective housing. The protective housing is typically provided with a series of small access points to the contacts. For example, the use of multi-contact devices is a well-known method for providing an organized and orderly connection of multiple leads, wires or cables. Multi-contact devices terminate conductors and cables between circuits within a system, between systems, and between systems and external power sources and signal lines. Multi-contact devices interconnect circuits on circuit boards with backplanes or backpanels or wiring within an enclosure.

In many instances, access to the mating electrical contact is restricted such that it is not possible to manually install the terminal thereto. In order to achieve a secure connection a tool of some sort must be used to extend the reach of the installer to connect the terminal to the mating contact.

Additionally, each terminal must be oriented properly with respect to its mating contact in order to make the proper connection. It is therefore important that a tool used to form the connection can maintain the orientation of the terminal with respect to the mating contact so as to avoid damage of the terminal and/or mating contact as well as to assure a proper seating. To this end, it is desirable for a tool to control the orientation of the terminal contact while connecting the terminal to a mating electrical contact.

Tools for connecting terminals to mating electrical contacts are known. U.S. Pat. No. 5,655,294 to Makino discloses a tool having a stepped tubular portion and a grip portion connected thereto. The tubular portion has a plurality of cylindrical portions. The diameter of the cylindrical portions increases from a distal cylindrical portion to a proximal cylindrical portion. A slit extends from the distal cylindrical portion to the proximal cylindrical portion of the tool. The slit allows a wire to pass through it. The tool is used to insert a metal terminal with a water proof seal into a cavity.

U.S. Pat. No. 6,311,392 to Lin discloses an insertion tool including an elongate body having a longitudinal concave portion therein which extends the length of the tool and is shaped in accordance with the size of the cord for which the tool is created. An elongate member extends from one end of the elongate body which is capable of receiving a crimp ring and stabilizing the cord during an insertion operation. An inner surface of the elongate member is shaped to accommodate a crimp ring portion of the crimp ring about the cord.

While these tools serve adequately in connecting terminals to mating contacts, there is a present need for tools which provide for installation and removal of differently sized terminals with respect to mating electrical contacts while also providing for proper orientation of the terminal with respect to the electrical contact.

SUMMARY OF THE INVENTION

The present invention provides a tool for effecting attachment of a wire terminated electrical terminal with respect to a mating electrical contact. An elongate tubular body includes a first opened end, a second opened end and a continuous slot from the first to the second opened end. The continuous slot defines a pair of inwardly deflectable opposed sidewalls, wherein the wire may be loosely received between the opposed sidewalls. A first recessed stop toward the first opened end of the tubular body is adapted to seat at least the terminal contact at the first opened end. The opposed sidewalls are inwardly deflectable so as to tightly grip the wire to effect attachment to the mating electrical contact.

Also provided is a tool for placement of a wire terminated electrical terminal with respect to a mating electrical contact. An elongate tubular body includes a first opened end a second opened end and a pair of opposed slots including a continuous slot from the first opened end to the second opened end and a slot extending toward the first and second opened ends. The slots together define a pair of opposed sidewalls. A first recessed stop toward the first end of the tubular body is adapted to seat at least the terminal. A wire attached to the terminal may be loosely received between the opposed sidewalls along an entire length of the tool.

Further provided is a tool for placement of a terminal with respect to a mating electrical contact, including a tubular body having a first opposed end and a second opened end. The tubular body has a pair of opposed slots including a continuous slot extending from the first opened end to the second opened end and having a uniform width. The opposed slots define a pair of inwardly deflectable opposed sidewalls. A wire attached to the terminal may be loosely received between the opposed sidewalls. A first recessed stop toward the first opened end of the tubular body is adapted to seat a first terminal attached to a first wire. A second recessed stop toward the second opened end of the tubular body is adapted to seat a second terminal attached to a second wire having a size different than the first terminal. The tool is configured so as to effect attachment of a plurality of terminals having different sizes. A flattened portion on each of the opposed sidewalls is also provided. The opposed sidewalls are configured to tightly hold the wire received between the opposed sidewalls upon application of a pressure to each flattened portion.

Further provided is a tool for effecting attachment of a wire terminated electrical terminal with respect to a mating electrical contact. The tool includes an elongate tubular body having a first opened end, a second end, a point of bend and a bent portion. The bent portion is defined as a portion of the tubular body between the first opened end and the point of bend. A portion of the tubular body between the first opened end and the point of bend defines a bent portion, the bent portion has a continuous slot extending from the first opened end to the point of bend and defining a pair of inwardly deflectable opposed sidewalls. The wire may be loosely received between the opposed sidewalls. The tool also incorporating a first recessed stop toward the first opened end of the bent portion, the first recessed stop being adapted to seat at least the terminal at the first opened end. The opposed sidewalls are inwardly deflectable so as to grip the wire to effect attachment to the electrical terminal. A second bent portion may also be incorporated at the other end of the elongated tubular body. The second bent portion being similar to the first bent portion.

BRIEF DESCRIPTION OF THE DRAWINGS

FIG. 2 is a top perspective view of a tool according to the invention.

FIG. 3 is a left side elevation view of the tool as shown in FIG. 2.

FIG. 4 is a right side elevation view of the tool as shown in FIG. 2.

DETAILED DESCRIPTION OF THE PREFERRED EMBODIMENTS

Figure 1:
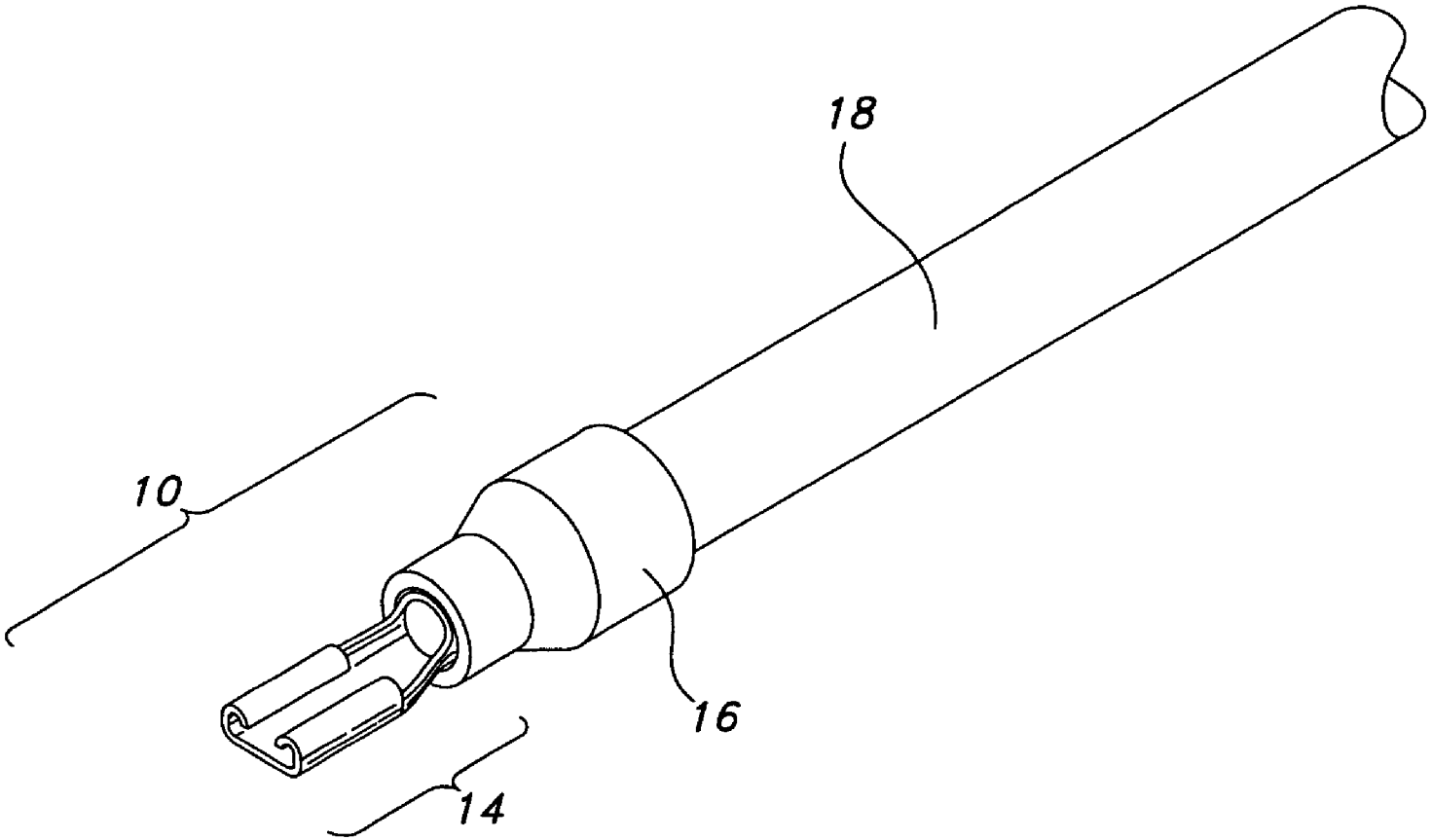
FIG. 1 is a top perspective view of a conventional terminal crimped to a wire.

In accordance with the present invention, a tool is provided for placement of a terminal with respect to a corresponding or mating electrical contact. The tool is of simple construction yet provides convenient design features which allow placement of a variety of sizes of terminals and their corresponding wires with respect to a variety of sizes of mating electrical contacts. Additionally, the tool provides for controlled orientation of the terminal by limiting rotation of at least the wire held within the tool. This feature is particularly advantageous when inserting terminals in tightly spaced mating electrical contacts that are otherwise inaccessible for manual insertion of the terminals.

With the foregoing and additional features in mind, this invention will now be described in more detail, and other benefits and advantages thereof will be apparent from the following detailed description when taken in conjunction with the accompanying drawings, in which like numerals represent identical elements throughout the several views.

Referring now to FIGS. 2, 3, 4, 5 and 6, an embodiment of the tool according to the invention is shown. The tool, generally referred to as reference numeral 20, includes an elongate tubular body 22 having a first opened end 24 and a second opened end 26. The tubular body 22 includes a continuous longitudinal slot 28 extending from the first opened end 24 to the second opened end 26 and an opposed longitudinal slot 30.

Tubular body 22, continuous longitudinal slot 28 and opposed longitudinal slot 30 together define opposed sidewalls 32, 34 and a channel 36 therebetween. Channel 36 includes opposed internal surfaces 38, 40 which are generally planar. Arranged centrally on each sidewall 32, 34 is a flattened portion 42, 44, respectively. Continuous longitudinal slot 28 and channel 36 are sized so as to accommodate a variety of different terminals having different gauge wires terminated thereon. In the embodiment shown, slot 28 tapers inwardly from the second open end 26 to the first open end 24. The wires are inserted into the continuous longitudinal slot 28 and are initially held loosely in channel 36. As will be described further below, a wire inserted into tool 20 may be held tightly in place after placement in channel 36 via continuous longitudinal slot 28. However, initially, wire 18 is held loosely in channel 36.

In a preferred aspect of the invention, opposed sidewalls 32, 34 are inwardly deflectable. In this embodiment, an installer may apply digital pressure to the flattened portions 42, 44, so as to inwardly deflect sidewalls 32, 34 toward one another. The deflected sidewalls 32, 34 serve to tightly hold a wire 18 placed therebetween.

Figure 5:
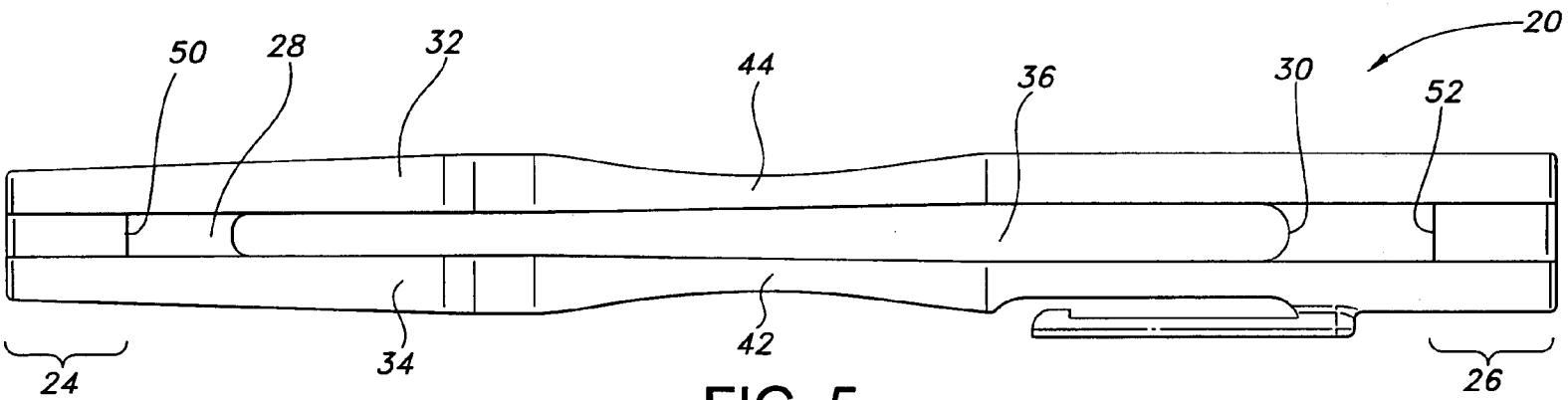
FIG. 5 is a rear elevation view of the tool as shown in FIG. 2.

As best shown in FIG. 5, which is a view in which continuous longitudinal slot 28 faces the viewer, a first recessed stop 50 is arranged toward first opened end 24 and a second recessed stop 52 is arranged toward second opened end 26. In this particular embodiment, each stop 50, 52 is a projection formed by a change in the shape of channel 36 at stop 50, 52. From each opened end 24, 26, to each stop 50, 52, respectively, channel 36 is generally circular or C-shaped. After each stop 50, 52, toward the center of tubular body 22, channel 36 includes generally planar opposed parallel internal surfaces 38, 40 with channel 36 being generally U-shaped. This change in cross section provides a stop surface of recessed stop 50, 52. Although a change in cross section is shown as providing a stop surface, the invention is not so limited. Other stop surfaces such as annular continuous or discontinuous rings or the like may also be used and are well within the scope of the invention.

In a preferred aspect of the invention, an internal diameter at first opened end 24 is smaller than an internal diameter at second opened end 26. With this configuration, it is possible to use a single tool of the invention for effecting attachment of a plurality of differently sized terminals terminated or crimped on differently sized wires. Preferably, the tool of the invention may be used to insert or remove a terminal crimped to a range of wire gauges of from about 5 AWG to about 25 AWG. In a further preferred aspect of the invention, an internal diameter at first opened end 24 is about 6 mm and an internal diameter at second opened end 26 is about 8 mm. The tool 20 is provided with a clip 46 for ease of carrying.

Referring again to FIG. 2, in an additional preferred aspect of the invention, tool 20 also includes one or more marking indicia. As shown, marking indicia 48*a*, 48*b* and 48*c* include circular indents arranged toward opened ends 24, 26. Specifically, first opened end 24 includes two adjacent circular indents 48*a*, 48*b* and second opened end 26 includes a single circular indent 48*c*. Often, insulating sleeve 16 of terminal 10 includes identifying indicia such as color-coding to differentiate the size or type of the terminal. In this aspect of the invention, marking indicia 48*a*, 48*b* and 48*c* are color-coded to match the color-coded sleeves so as to alert an installer as to the proper end of the tool in which to place a terminal to be installed. In use, the installer will match the color of the marking indicia to the color on sleeve 16. The terminal will be placed in the end of the tool that is color-coded to match the color of sleeve 16 surrounding terminal 10. Wire 18 will exit the other end of the tool. Although three marking indicia are shown, this is merely exemplary. Any number of marking indicia may be used to show the full scope of terminals and associated wire gauges that can be accommodated in the tool of the invention.

In one important aspect of the invention, when the terminal is placed in the tool, rotation of the terminal, about an axis defined by elongate tubular body, may be limited in at least one of two ways. First, the proximal crimped portion of terminal and/or sleeve is in a shape, such as an oval configuration, which is constrained when the proximal crimped portion is placed in second opened end 26 so as to resist rotation therein.

Figure 6:
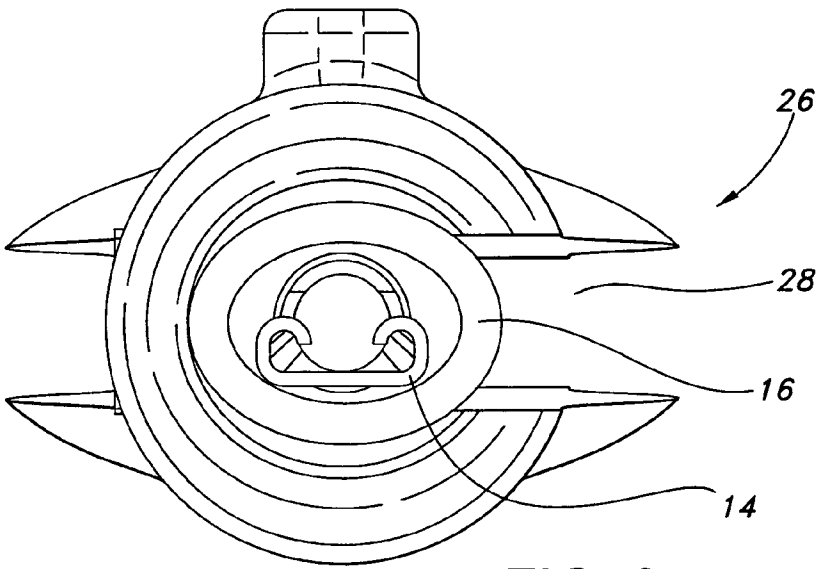
FIG. 6 is a side and top perspective view of a tool according to the invention with a terminal received therein and seated over a mating electrical contact.

Referring now to FIG. 6, one example of constraint from rotation of a terminal 10 in a tool 20 of the invention is shown. In this case, the constraint occurs when a diameter of an oval-shaped terminal 10 and surrounding insulating sleeve 16 at its widest point exceeds slightly the inside diameter of second opened end 26 in which it is placed. In this particular configuration, a portion of the widest diameter of the oval, in this case the shape of sleeve 16, protrudes slightly into continuous longitudinal slot 28 effectively limiting rotation of terminal 10 within tool 20. Other configurations will be appreciated by those of skill in the art and are well within the scope of the invention.

Figure 7:
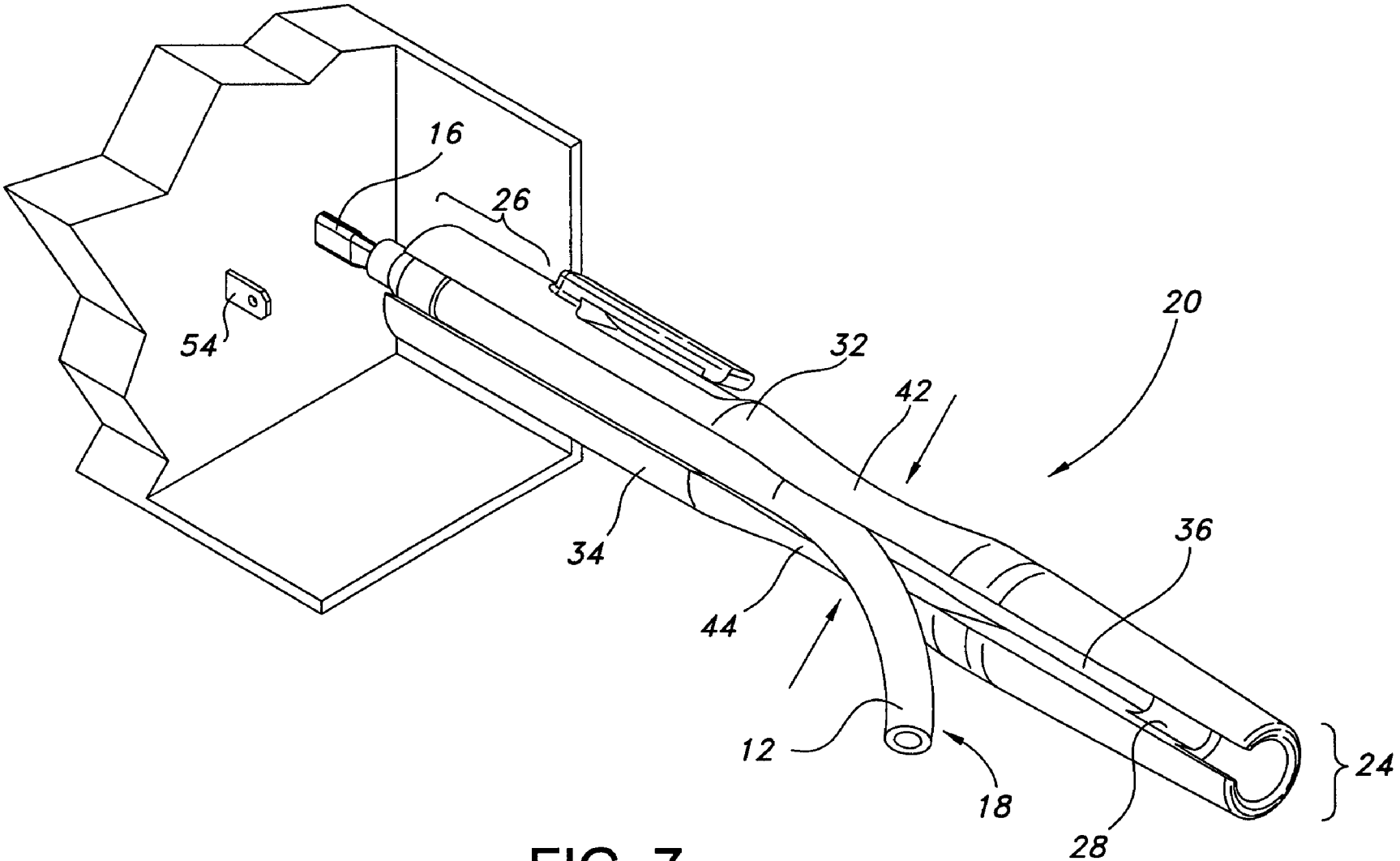
FIG. 7 is the tool as shown in FIG. 4, with a distal terminating portion of a terminal shown inside the tool.

A second way in which rotation of terminal 10 within tool 20 may be prevented is by inward deflection of sidewalls 32, 34. As best shown in FIG. 7, flattened portions 42, 44 of sidewalls 32, 34 may be pressed together by the installer in the direction of arrows so as to cause sidewalls 32, 34 to deflect inwardly so as to grip wire 18 in place. The gripping action effectively prevents rotational movement of wire 18 and consequently of terminal 10 in tool 20. The advantages of such control of rotational movement are clear. By being able to control the orientation of the terminal in relation to the mating electrical contact, the likelihood of damage to either part is reduced and the likelihood of creating a full and effective attachment is increased.

Referring now to FIG. 7, use of tool 20 to form a connection with a mating electrical contact 54 is shown. In this example, a female terminal 10 is shown having terminal (not shown) crimped or otherwise attached to a wire 18. Terminal (not shown), having a distal contact portion and a proximal crimp barrel portion is fully covered by insulating sleeve 16. Terminal 10 is first placed in tool 20 via continuous longitudinal slot 28 so that at least the distal connection portion of terminal 10 protrudes from second opened end 26 of tool 20. Next, wire 18 is pulled toward first opened end 24 until second recessed stop (not shown) prevents further travel of terminal 10. When properly placed, the distal connection portion of terminal 10 is exposed through second opened end 26.

Figure 8:
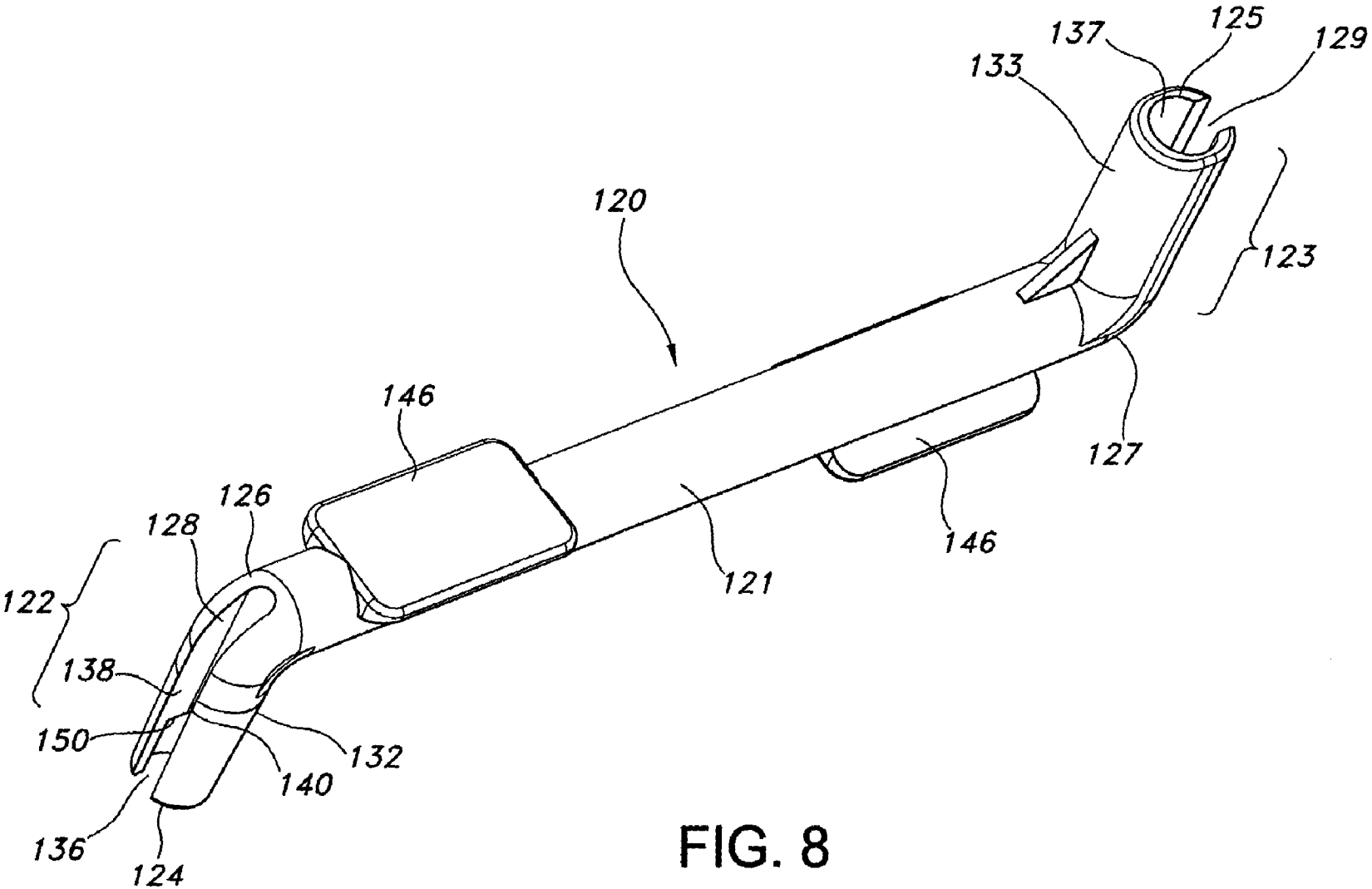
FIG. 8 is a side perspective view of a tool according to the invention having a bent configuration.
Figure 9:
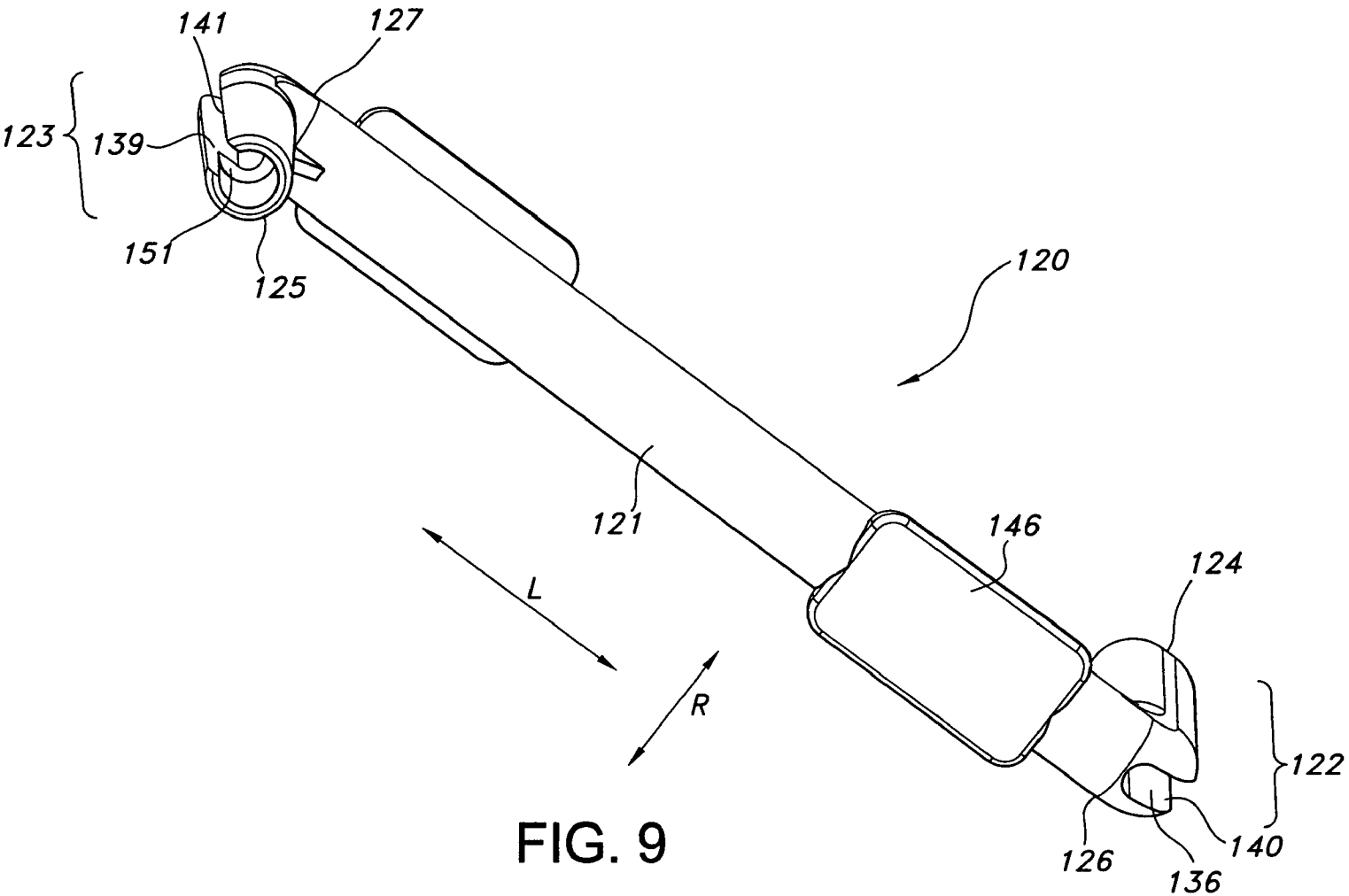
FIG. 9 is a top perspective view of the tool as shown in FIG. 7.

Referring now to FIGS. 8 and 9, an embodiment of the tool 120 is similar to tool 20 of FIGS. 2-6, but tool 120 is bent at either ends to provide access to offset locations, around corners or areas having limited space to operate. Generally, elongated bodies 122 and 123, at either end of bar 121, of FIGS. 8 and 9, are similar in construction and function to elongated body 22 of FIGS. 2-6.

Referring now to FIGS. 8 and 9, tool 120 includes an elongate tubular body having two bent portions at either end. Herein, the unbent portion of the tool is referred to as the bar 121, and the bent portions are referred to as tubular bodies 122, 123. The tubular bodies 122, 123 have first opened ends 124, 125 and points of bend 126,127, respectively. The bar 121 is defined as the portion between the points of bend 126,127. The tubular bodies 122, 123 are attached perpendicularly to bar 121 in opposite directions relative to each other such that the tool 120 has a generally straightened "Z" shape, as shown in FIG. 8. FIGS. 8 and 9 show tubular bodies 122, 123 bent at an angle of about 90 degrees from the longitudinal axis L of the bar 121, and the tubular bodies 122, 123 are 180 degrees opposed in relation to the radial axis R of the bar 121. However, it is contemplated that the tubular bodies 122, 123 may be bent at a variety of angles in relation to the longitudinal axis L of the bar 121, and/or each tubular body 122, 123 may be bent at different angles. Similarly, the tubular bodies 122, 123 may be rotated about the radial axis R of bar 121 to different angles with respect to each other. For example, in relation to the longitudinal axis L of the bar, one elongated body may be attached to the bar at a 225 degree angle and the other elongated body may be attached at a 90 degrees angle (as similarly shown in FIG. 8), and, in relation to the radial axis R of the bar, the elongated bodies may be rotated about the bar such that they are offset 90 degrees from each other, instead of 180 degrees as shown in FIG. 8. Numerous configurations are contemplated based on the adjustment of angles to meet the desired use.

Further, the tubular bodies 122, 123 include continuous longitudinal slots 128, 129 extending from the first opened ends 124, 125 to the points of bend 126, 127. The tubular bodies 122, 123 include a discontinuous sidewalls 132,133, and channels 136, 137 therethrough. Channels 136, 137 include opposed parallel internal surfaces 138, 140 and 139, 141, respectively, which are generally planar providing a "U" shape configuration within the channels 136, 137. The parallel internal surfaces 138, 140 and 139, 141 are inset from the first ends 124, 125 within the channels 136, 137. Continuous longitudinal slots 128, 129 and channels 136, 137 are sized so as to accommodate a variety of different terminals having different gauge wires terminated thereon. The wires are inserted into the continuous longitudinal slots 128, 129 and are held in place after placement in channels 136, 137 and the planar internal surfaces 138, 140 and 139, 141. The opposed parallel internal surfaces 138, 140 are inwardly deflectable, so as to grip the wire to effect attachment to the electrical terminal. Additionally, tool 120 is provided with clips 146 for ease of carrying.

Further, as similarly discussed above in relation to the tool 20 in FIGS. 2-6, the channels 136, 137 include recessed stops 150, 151 which are the inset ends of the parallel internal surfaces 138, 140 and 139, 141 within the channels 136, 137, as shown in FIGS. 8 and 9. The recessed stops 150, 151 are the point in the channels 136, 137 where the parallel internal surfaces 138, 140 and 139, 141 end. The channels 136, 137 return to the "C" shape configuration from the recessed stops 150, 151 to the first open ends 124, 125. The recessed stops 150, 151 are adapted to seat at least a terminal at the first opened ends 124, 125.

The tool of the invention is preferably of uniform construction of an insulating material such as plastic. For example, the tool may be made from a plastic material such as polypropylene or polyethylene or a combination thereof. The tool can also be made from a combination of plastic, rubber or thermoplastic elastomer materials. The tool can be made using conventional injection molding or co-injection techniques known to those having skill in the art.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A tool for effecting attachment of a wire terminated electrical terminal with respect to a mating electrical contact, said tool comprising:

an elongate tubular body having a first opened end, a second end, a point of bend and a bent portion, said bent portion being defined as a portion of said tubular body between said first opened end and said point of bend, said bent portion is perpendicular to said tubular body, said bent portion having a continuous slot extending from said first opened end to said point of bend and defining a pair of inwardly deflectable opposed sidewalls, wherein said wire may be loosely received between said opposed sidewalls, wherein said tubular body further comprises a second point of bend and a second bent portion, said second bent portion being defined as a portion of said tubular body between said second end and said second point of bend, said second bent portion having a continuous slot extending from said second end to said second point of bend and defining a pair of inwardly deflectable opposed second sidewalls, wherein said wire may be loosely received between said opposed second sidewalls;

a first recessed stop toward said first opened end of said bent portion, said first recessed stop being adapted to seat at least said terminal at said first opened end, wherein said opposed sidewalls are inwardly deflectable so as to grip said wire to effect attachment to said electrical terminal; and a second recessed stop toward said second end of said second bent portion, said second recessed stop being adapted to seat at least said terminal at said second end, wherein said second opposed sidewalls are inwardly deflectable so as to grip said wire to effect attachment to said electrical terminal.

2. A tool for effecting attachment of a wire terminated electrical terminal with respect to a mating electrical contact, said tool comprising:

an elongate tubular body having a first opened end, a second opened end and a tubular sidewall extending therebetween, said tubular sidewall includes a continuous slot and an opposing slot, said continuous slot extends through said sidewall and said continuous slot extends from said first opened end to said second opened end, said opposing slot extends through a portion of said sidewall on an opposite side of said sidewall from said continuous slot, said opposing slot is shorter than said continuous slot, said continuous slot and said opposing slot from a channel through said sidewall said channel defines a pair of inwardly deflectable parallel opposed walls, wherein said wire may be loosely received between said opposed walls; and a first recessed stop toward said first opened end of said tubular body, said first recessed stop being adapted to seat at least a terminal at said first opened end, wherein said opposed walls are inwardly deflectable so as to grip said wire to effect attachment to said electrical terminal.

3. The tool of claim 1, wherein said continuous slot tapers from one of said ends to the other of said end.

4. The tool of claim 3, wherein said first opened end and said second opened end have internal diameters that are sufficient to accommodate a range of wire gages from about 5 AWG to about 25 AWG.

5. The tool of claim 1, further comprising a flattened portion on each of said opposed sidewalls, wherein each said flattened portion is configured to deflect inwardly to tightly grip said wire received between said opposed walls.

6. The tool of claim 5, wherein each said flattened portion is arranged adjacent a center of said tubular body.

7. The tool of claim 6, wherein each said flattened portion forms a finger pad for holding said tool.

8. The tool of claim 1, wherein said first recessed stop is substantially rigid.

9. The tool of claim 8, wherein said first open end of said tubular body is generally circular so as to accommodate a proximal crimp barrel portion in a manner which resists rotation therein.

10. The tool of claim 1, further comprising a second recessed stop toward said second opened end of said tubular body, said second recessed stop being adapted to seat at least a second contact terminal at said second opened end, said second opened end having a size different than said first opened end, wherein said tool is configured so as to effect attachment of a plurality of terminals having different sizes.

11. The tool of claim 10, wherein said second recessed stop is substantially rigid.

12. The tool of claim 11, wherein said second open end of said tubular body is generally circular so as to accommodate a crimp barrel terminal portion in a manner which resists rotation therein.

13. The tool of claim 12, wherein said tool includes identifying indicia on said tubular body to differentiate which of said opened ends accommodates a specific terminal size.

14. The tool of claim 13, wherein said identifying indicia is color-coded to correspond to colored terminal sleeves.

* * * * *

UNITED STATES PATENT AND TRADEMARK OFFICE

CERTIFICATE OF CORRECTION

PATENT NO. : 7,644,494 B2
APPLICATION NO. : 11/049165
DATED : January 12, 2010
INVENTOR(S) : Cong Thanh Dinh It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 624 days.

Signed and Sealed this

Sixteenth Day of November, 2010

David J. Kappos

David J. Kappos
*Director of the United States Patent and Trademark Office*